US005136129A

United States Patent [19]

Kaigler et al.

[11] Patent Number: 5,136,129

[45] Date of Patent: Aug. 4, 1992

[54] PRESSURE OPERATED SWITCH CONSTRUCTION AND METHOD OF MAKING

[75] Inventors: William J. Kaigler, North Huntingdon; Thomas M. Buckshaw, Indiana; David T. Llewellyn, Ebensburg, all of Pa.

[73] Assignee: Robertshaw Controls Company, Richmond, Va.

[21] Appl. No.: 479,956

[22] Filed: Feb. 14, 1990

[51] Int. Cl.[5] ..... H01H 35/34

[52] U.S. Cl. ..... 200/83 R; 200/83 WM; 200/83 P; 200/83 S

[58] Field of Search ..... 200/81 R, 83 R, 83 WM, 200/83 S, 83 P, 83 SA

[56] References Cited

U.S. PATENT DOCUMENTS

| | | | |
|---|---|---|---|
| 3,230,328 | 1/1966 | Chapin | 200/83 WM X |
| 3,249,712 | 5/1966 | Rhodes et al. | 200/83 WM X |
| 3,267,232 | 8/1966 | Chapin | 200/83 WM |
| 3,598,946 | 8/1971 | Hanssen et al. | 200/83 WM |
| 4,081,637 | 3/1978 | Stearley et al. | 200/83 WM |
| 4,104,495 | 8/1978 | Jones et al. | 200/83 P |
| 4,192,980 | 3/1980 | Kothe | 200/83 WM |
| 4,262,178 | 4/1981 | Berlin, Jr. | 200/81 R |

*Primary Examiner*—J. R. Scott

*Attorney, Agent, or Firm*—Candor, Candor & Tassone

[57] ABSTRACT

A pressure operated switch construction and method of making the same are provided, the pressure operated switch construction comprising a housing having an external surface and carrying an electrical switch unit and a diaphragm assembly therein, the housing having an opening passing through the external surface thereof, the electrical switch unit having opposed sides and an opening passing therethrough in alignment with the opening of the housing, and a compression spring unit carried by the housing and being operatively associated with the electrical switch unit and the diaphragm assembly to control the operation thereof in relation to the compression setting of the compression spring unit, the compression spring unit comprising a retainer operatively interconnected to the electrical switch unit, an actuator carried by the housing and a compression spring having opposed ends respectively bearing against the actuator and the retainer, the retainer having an intermediate part disposed in the opening of the housing and having a surface and a projection extending from the surface and passing through the opening of the electrical switch unit in one direction so that the surface thereof faces one of the sides thereof whereby the retainer is removable from the electrical switch unit by merely moving the retainer in the direction opposite to the one direction.

3 Claims, 6 Drawing Sheets

PRESSURE OPERATED SWITCH CONSTRUCTION AND METHOD OF MAKING

BACKGROUND OF THE INVENTION

1. Field of the Invention

This invention relates to a new pressure operated switch construction and to a new method of making such a pressure operated switch construction.

2. Prior Art Statement

It is known to provide a pressure operated switch construction comprising a housing means having an external surface means and carrying an electrical switch unit and a diaphragm assembly therein, the housing means having an opening means passing through the external surface means thereof, the electrical switch unit having opposed sides and an opening passing therethrough in alignment with the opening means, and a compression spring means carried by the housing means and being operatively associated with the electrical switch unit diaphragm assembly to control the operation thereof in relation to the compressive setting of the compression spring means, the spring means comprising a retainer operatively interconnected to the electrical switch unit, an actuator carried by the housing means, and a compression spring having opposed end means respectively bearing against the actuator and the retainer. For example, see the Rhodes et al, U.S. Pat. No. 3,249,712.

SUMMARY OF THE INVENTION

It is one feature of this invention to provide a new pressure operated switch construction having a new compression spring means wherein the retainer thereof is adapted to be readily assembled to the electrical switch unit without requiring a separate component to transmit the force from the electrical diaphragm assembly to the switching mechanism of the switch unit.

In particular, it was found according to the teachings of this invention that a retainer for the compression spring means can have an intermediate part thereof disposed in an opening means in the external surface means of the housing means and have a surface provided with a projection extending beyond the same with that projection passing through an opening in the electrical switch unit so that the surface of the retainer faces one side of the electrical switch unit.

In this manner, the retainer of this invention can be assembled to the housing means after the electrical switch unit and the diaphragm assembly have been sealed therein.

For example, one embodiment of this invention provides a pressure operated switch construction comprising a housing means having an external surface means and carrying an electrical switch unit and a diaphragm assembly therein, the housing means having an opening means passing through the external surface means thereof, the electrical switch unit having opposed sides and an opening passing therethrough in alignment with the opening means, and a compression spring means carried by the housing means and being operatively associated with the electrical switch unit and the diaphragm assembly to control the operation thereof in relation to the compressive setting of the compression spring means, the compression spring means comprising a retainer operatively interconnected to the electrical switch unit, an actuator carried by the housing means and a compression spring having opposed end means respectively bearing against the actuator and the retainer, the retainer having an intermediate part disposed in the opening means of the housing means and having a surface means and a projection means extending from the surface means and passing through the opening of the electrical switch unit in one direction so that the surface means thereof faces one of the sides thereof whereby the retainer is removable from the electrical switch unit by merely moving the retainer in the direction opposite to the one direction.

It is another feature of this invention to provide the actuator of the pressure operated switch construction to merely comprise a member that is slidably disposed within a chamber of the housing means without requiring the actuator to be hinged thereto as in prior known pressure operated switch constructions.

Accordingly, it is an object of this invention to provide a new pressure operated switch construction having one or more of the novel features of this invention as set forth above or hereinafter shown or described.

Another object of this invention is to provide a new method of making such a pressure operated switch construction, the method of this invention having one or more of the novel features of this invention as set forth above or hereinafter shown or described.

Other objects, uses and advantages of this invention are apparent from a reading of this description which proceeds with reference to the accompanying drawings forming a part thereof and wherein:

DESCRIPTION OF THE PREFERRED EMBODIMENTS

Figure 1:
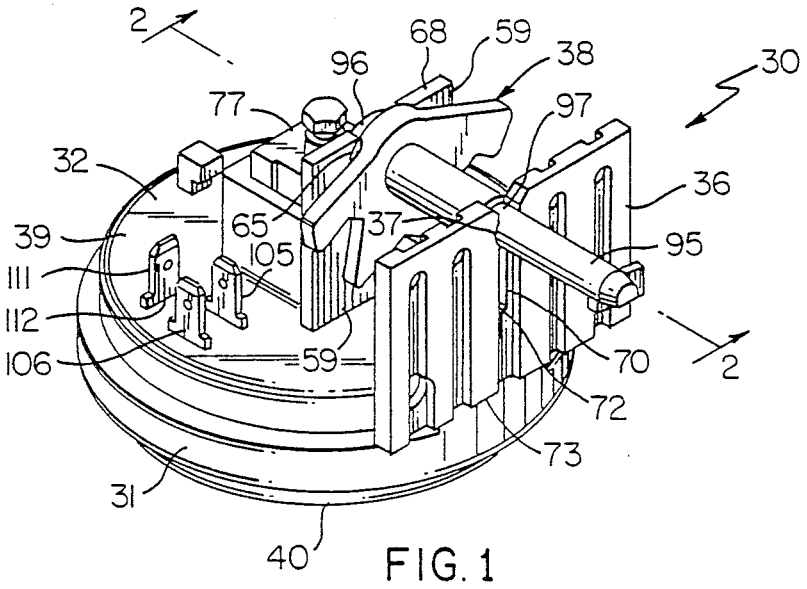
FIG. 1 is a perspective view of the new pressure operated switch construction of this invention.

While the various features of this invention are hereinafter illustrated and described as being particularly adapted to provide a pressure operated switch construction for controlling the water level in a laundry machine, it is to be understood that the various features of this invention can be utilized singly or in various combinations thereof to provide a pressure operated switch construction for other apparatus as desired.

Therefore, this invention is not to be limited to only the embodiment illustrated in the drawings, because the drawings are merely utilized to illustrate one of the wide variety of uses of this invention.

Figure 2:
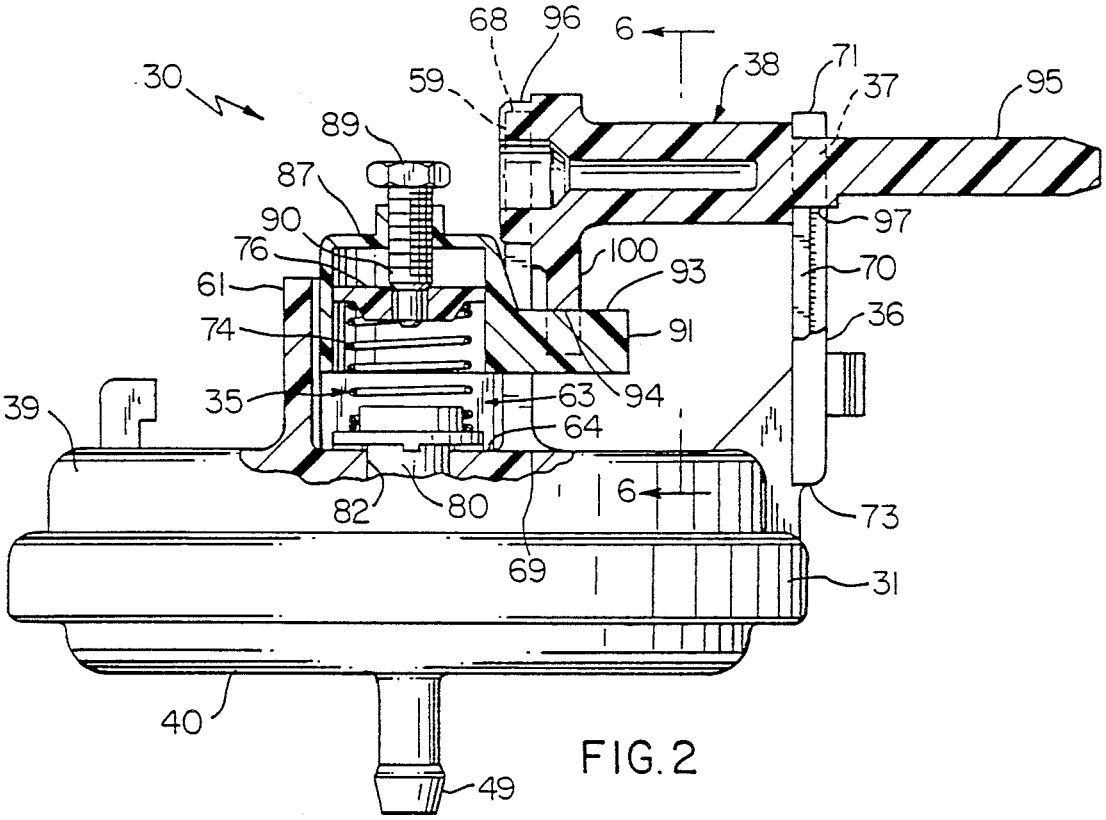
FIG. 2 is an enlarged side view of the pressure operated switch construction of FIG. 1 and is partially in cross section as taken on line 2—2 of FIG. 1.
Figure 3:
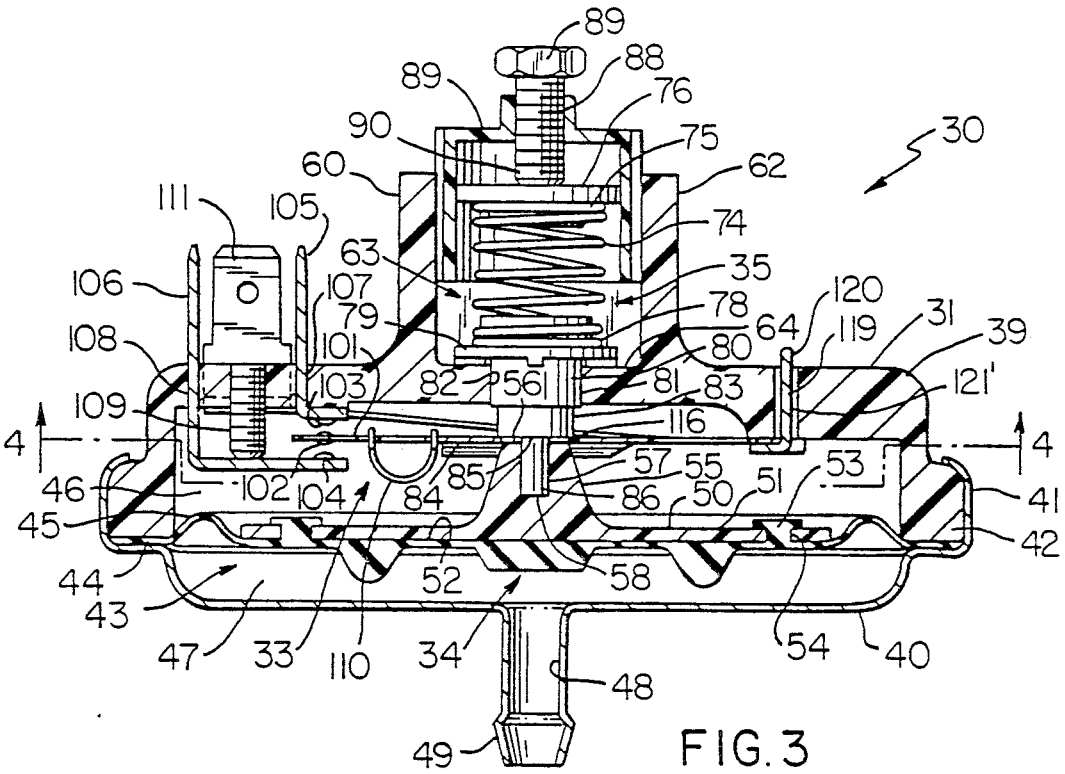
FIG. 3 is an enlarged cross-sectional view taken on line 3—3 of FIG. 1.

Referring now to FIGS. 1–7, a new pressure operated switch construction of this invention is generally indicated by the reference numeral 30 and comprises a housing means 31 having an external surface means 32 and carrying an electrical switch unit that is generally indicated by the reference numeral 33 in FIG. 3 and a diaphragm assembly that is generally indicated by the reference numeral 34 in FIG. 3 therein, and a compression spring means that is generally indicated by the reference numeral 35 in FIG. 3 carried by the housing means 31 and being operatively associated with the electrical switch unit 33 and the diaphragm assembly 34 to control the operation thereof in relation to the compressive setting of the spring means 35, the housing means 31 having a bracket member 36 extending outwardly from the external surface means 32 and having mounting means 37 for mounting a movable actuator means that is generally indicated by the reference numeral 38 in FIG. 1 and is adapted to be operatively associated with the spring means 35 to select the desired compressive setting thereof.

Such structure is generally set forth in the Stearley et al, U.S. Pat. No. 4,081,637 whereby this patent is being incorporated into this disclosure by this reference thereto.

Since the general operation of a pressure operated switch construction for controlling the liquid level in a laundry machine is well known in the art as set forth in the aforementioned Stearley et al, U.S. Pat. No. 4,081,637 as well as set forth in the aforementioned Rhodes et al, U.S. Pat. No. 3,249,712 which patent is also being incorporated into this disclosure by this reference thereto, only the details of the various pressure operated switch constructions of this invention need be set forth.

The housing means 31 of the pressure operated switch construction 30 is formed from a first cup-shaped housing member or body part 39 formed of any suitable material, such as plastic material, and another cup-shaped housing member 40 formed of any suitable material, such as metallic material, and having its open end 41 turned over and around part of an open end 42 of the housing member 39 to not only hold the housing members 39 and 40 together to define a chamber 43 within the housing means 31, but also to hold an outer peripheral portion 44 of a flexible diaphragm 45 of the diaphragm assembly 34 therebetween so that the diaphragm 45 divides the chamber 43 into two chamber sections 46 and 47 that are sealed from each other by the flexible diaphragm 45.

The chamber section 47 of the housing means 31 is adapted to be in communication with a fluid pressure directed thereto through a passage means 48 in a tubular extension 49 of the housing member 40 in a manner well known in the art whereby the position of the diaphragm 45 is controlled by the resulting pressure differential operating across the diaphragm 45 as the chamber section 46 is at atmospheric conditions since the chamber section 46 is not sealed from the exterior of the housing member 39 whereby the compression spring means 35 in cooperation with the pressure differential acting across the flexible diaphragm 45 determines the position of the diaphragm 45 and, thus, the operative condition of the electrical switch unit 33 in a manner well known in the art.

While the flexible diaphragm 45 can be formed of any suitable polymeric material, such as rubber, a more rigid diaphragm backup member 50 has a disc-like portion 51 thereof disposed against the side 52 of the diaphragm 45 and is interconnected thereto in any suitable manner, such as by having rivet-like portions 53 of the diaphragm 45 respectively disposed through a circular array of openings 54 in the disc-like portion 51 of the backup member 50.

The diaphragm backup member 50 can be formed of any suitable material, and in the embodiment illustrated in the drawings, the backup member 50 is formed of a relatively rigid plastic material, and has a central projection 55 extending therefrom and terminating at a substantially flat end surface 56 which is interrupted by an opening 57 that defines an internal shoulder 58 in the central projection 55 for a purpose hereinafter set forth.

The housing member 39 has four interconnected substantially flat walls 59, 60, 61 and 62 extending outwardly therefrom and defining an opening 63 therebetween which has a substantially rectangular cross-sectional configuration and terminates at a substantially flat surface 64 at the bottom thereof as illustrated in FIG. 3, the wall 59 comprising another bracket member of the housing means 31 that is disposed in spaced parallel relation to the first bracket member 36 and also having mounting means 65 for cooperating with the mounting means 37 of the bracket member 36 to rotatably mount the actuator means 38 thereto in a manner hereinafter set forth.

It can be seen that the bracket members 36 and 59, as well as the walls 60–62 are a one-piece structure with the housing member 39 and can be formed during a molding operation of a plastic material to form the cup-shaped housing member 39.

Figure 5:
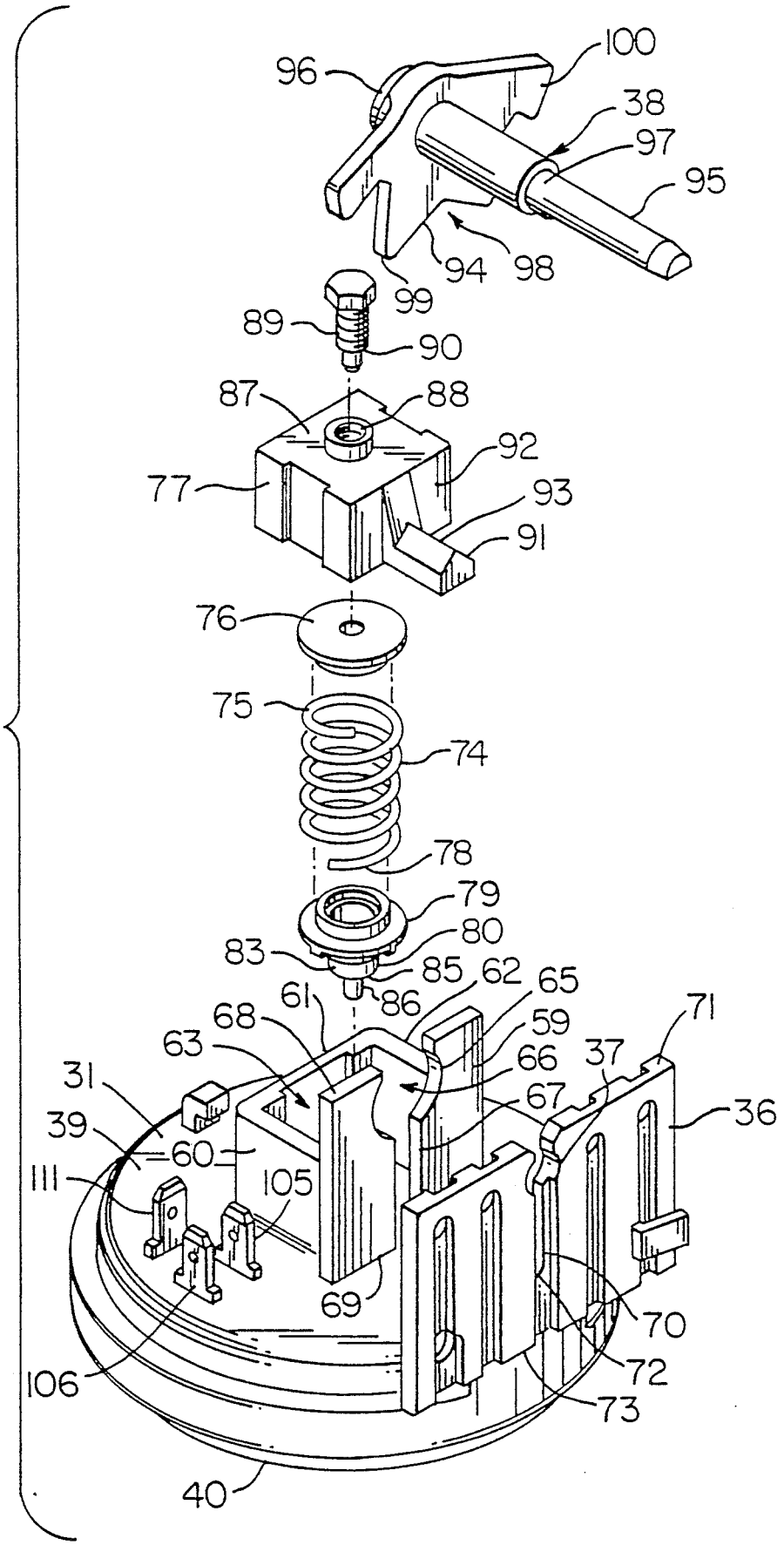
FIG. 5 is an exploded perspective view of certain parts of the pressure operated switch construction of FIG. 1.
Figure 6:
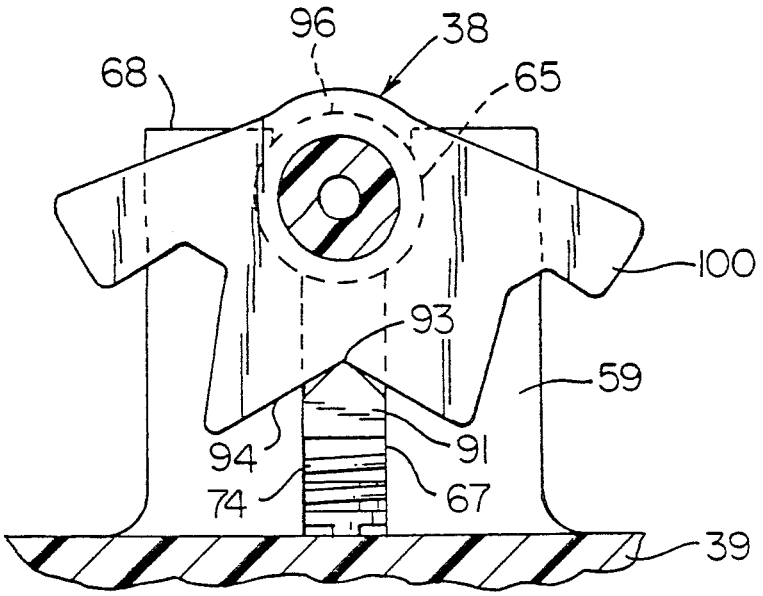
FIG. 6 is a fragmentary cross-sectional view taken on line 6—6 of FIG. 2.

The mounting means 65 of the wall or bracket member 59 comprises a substantially circular opening 66 formed therethrough and being bisected by a slot means 67 that extends from a top 68 of the wall 59 to a bottom 69 thereof as illustrated in FIG. 5, the mounting means 37 of the bracket member 36 likewise comprising a substantially circular opening passing through the bracket member 36 and being bisected by a slot means 70 that extends from a top 71 of the bracket member 36 to a point 72 intermediate the top 71 and a bottom 73 of the bracket member 36 as illustrated in FIG. 5 for a purpose hereinafter set forth.

A coiled compression spring 74 is disposed in the chamber 63 and has one end 75 bearing against a disc member 76 disposed in a spring actuator 77 that is disposed for sliding movement in the chamber 63 and has another end 78 bearing against a disc-like portion 79 of a retainer 80 that has a reduced cylindrical portion 81 passing through a circular opening 82 in the housing member 39 so that a further reduced cylindrical portion 83 thereof will trap a center blade 84 of the electrical switch unit 33 between an end surface 85 of the portion 83 of the retainer 80 and the end surface 56 of the central projection 55 of the diaphragm assembly 34 while a further reduced portion 86 of the retainer 80 passes through the center blade 84 and is received in the opening 57 of the diaphragm assembly 34 as illustrated in FIG. 3.

In this manner, the compressive force of the compression spring 74 maintains the center blade 84 of the electrical switch unit 33 between the retainer 80 and the diaphragm assembly 34 so as to control the operation of the electrical switch means 33 in a manner hereinafter set forth.

The spring actuator 77 has a rectangular cross-sectional configuration that permits the same to move axially in the chamber 63 of the housing part 39 while being non-rotatable relative thereto, the spring actuator 77 having a closed end wall 87 that is provided with a threaded opening 88 therethrough and carrying a threaded adjusting member 89 that has its end 90 bearing against the disc 76 so as to calibrate the compression spring 74 in a manner well known in the art.

The spring actuator 77 has an extension 91 extending out of a wall 92 thereof and being provided with a cam follower surface 93, the extension 91 being adapted to project through the slot means 67 of the bracket member 59 so as to be disposed intermediate the bracket members 36 and 59 to be operated on by a cam surface 94 of the actuator means 38 which positions the spring actuator 77 in the chamber 63 of the housing member 39 and, therefore, determines the desired compressive setting of the compressive spring means 35 and, thereby, setting the water level that the pressure operated switch construction 30 is to provide as fully disclosed in the aforementioned Stearley et al, U.S. Pat. No. 4,081,637, and the Rhodes et al, U.S. Pat. No. 3,249,712.

While the spring actuator 77 can be formed of any suitable material, such as plastic material, it can be seen that the spring actuator is a one-piece structure except for the disc member 76 and adjusting member 89 thereof.

Therefore, it can be seen that the spring means 35 of the pressure operated switch construction comprises the spring actuator 77 and its related parts, the compression 74 and the spring retainer 80.

The actuator means 38 of the pressure operated switch construction 30 comprises a rotary actuator means having a longitudinal shaft means 95 that has a cylindrical end portion 96 that is adapted to snap-fit into the circular opening 66 of the bracket member 59 in the manner illustrated in FIGS. 1 and 2 while a reduced cylindrical portion 97 of the shaft means 95 is adapted to be snap-fitted into the mounting means 37 of the bracket member 36 as illustrated in FIGS. 1 and 2, the mounting means 65 and 37 permitting the shaft means 95 to be rotatable relative thereto as fully set forth in the aforementioned Stearley et al, U.S. Pat. No, 4,081,637, and permit the cam surface 94 of the actuator means 39 to operate on the extension 91 of the spring actuator 77 and position the same in relation to spaces 98 between cam lobes 99 of a cam structure 100 carried by the shaft means 95.

The shaft means 95 can be formed of any suitable material, such as the plastic material as illustrated, and be a one-piece structure, if desired.

Thus, even though the shaft means 95 is snap-fit into the mounting means 37 and 65 of the bracket member 36 and 59, the shaft means 95 is adapted to rotate relative thereto about the longitudinal axis of the shaft means 95 and control the position of the actuator means 77 in the chamber 63 of the housing member 39 and, thus, the compressive force setting of the compression spring 74 opposing the upward movement of the diaphragm 45 all for a purpose well known in the art.

The electrical switch unit 33 has an outer switch blade 101 provided with contact means 102 thereon which is adapted to cooperate with either a first fixed contact means 103 or a second fixed contact means 104 respectively carried by terminal members 105 and 106 that project out of suitable opening means 107 and 108 in the housing member 39 while being secured thereto in any suitable and conventional manner, the position of the fixed contact means 103 in the housing means 31 being adjustable by a set screw means 109 threadedly carried by the housing member 39 in a manner well known in the art.

The main blade 101 of the electrical switch unit 33 is interconnected to the center blade 84 by a rolling spring 110 which causes the main blade 101 to move against either the lower fixed contact means 103 or the upper fixed contact means 104 depending upon the position of the center blade means 84 under the control of the spring means 35 and diaphragm assembly 34 in a manner well known in the art, the main blade 101 being electrically interconnected in a manner hereinafter set forth to another terminal 111 which also projects through a suitable opening 112 in the housing member 39 and is fastened thereto by staking so as to be positioned adjacent the terminals 105 and 106 and to be respectively electrically interconnected thereto by the operative position of the main blade 101.

The electrical switch unit 33 is uniquely formed so that the same is adapted to be assembled with the housing member 39 in a self-piloting manner and thereby does not require a riveting and assembly positioning operation as required by prior known switchblade assemblies for pressure operated switch constructions, the unique switch unit 33 with its self-piloting feature comprising the invention of William J. Kaigler as set forth in the copending patent application, Ser. No. 479,957 filed Feb. 14, 1990.

In particular, it is well known that the electrical switch unit of a pressure operated switch construction is one of the important mechanisms thereof. In the past, the switching means generally consisted of a main blade, a center blade and a roll spring, the center blade being a stationary part which only serves as a foundation for the roll spring during operation with the roll spring and main blade being two components which cause the snap action switching. Since three separate parts are used in the prior known blade design, it is necessary to orient them properly during the assembly process to the housing means. In addition, a rivet is normally used to attach the blade assembly to the housing body while the blade assembly is being oriented so that the process serves to be costly and a prime opportunity for errors.

Figure 4:
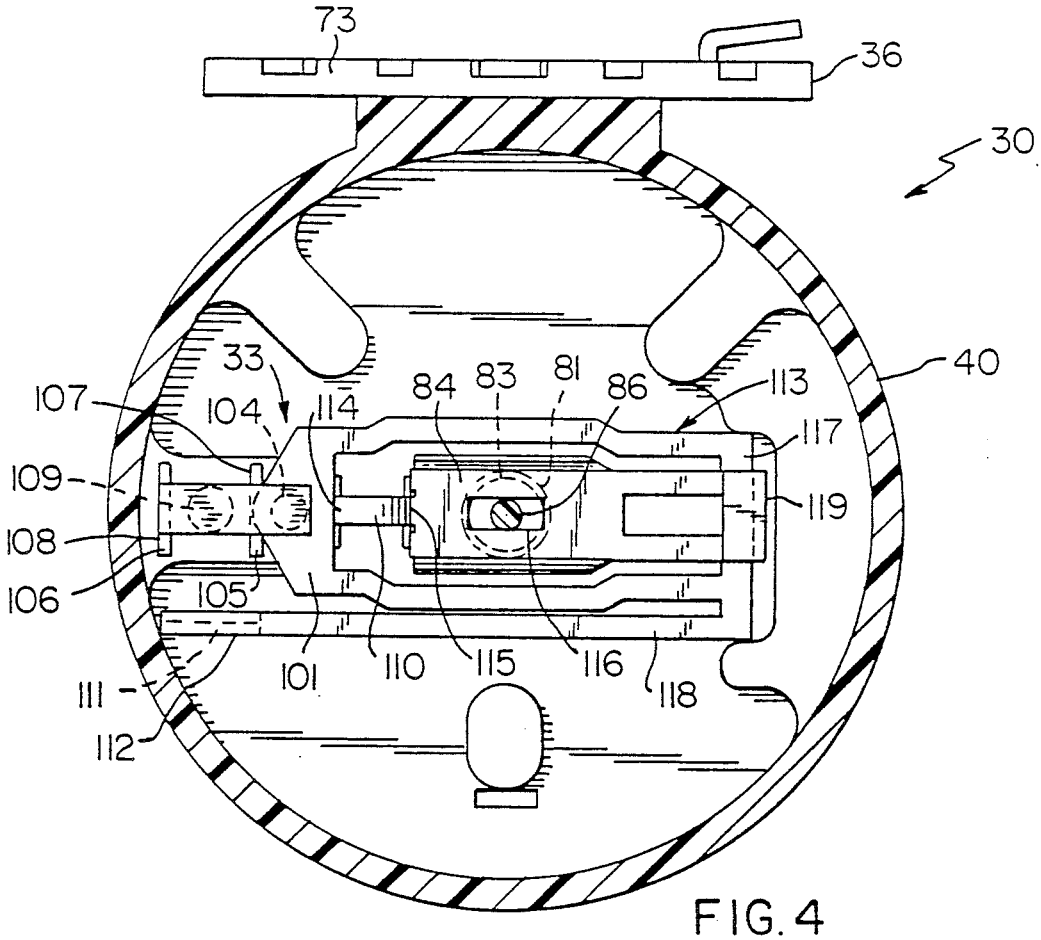
FIG. 4 is a cross-sectional view taken on line 4—4 of FIG. 3.

However, the electrical switch unit 33 comprises a self-contained subassembly that is generally indicated by the reference numeral 113 in FIG. 4 that can be treated as one part and therefore eliminates the need to keep track of each individual component of the switching mechanism. In addition, since the subassembly 113 is staked into the body member 39 in a manner hereinafter set forth, no connectors, such as rivets, are needed and the nature of the subassembly 113 allows it to be self-piloting so that no positional fixturing is necessary during assembly.

In particular, the center blade 84 and main blade 101 are formed from a one-piece metallic member that is suitably stamped and formed into the configuration illustrated in FIG. 4 so that the roll spring 110 can have its opposed ends 114 and 115 respectively snap-fitted to the center blade 84 and main blade 101 in a conventional manner, the center blade 84 having a rectangular opening 116 passing therethrough to permit the extension 86 of the retainer 80 to pass therethrough as illustrated in FIG. 4 and being held between the surface 85 of the retainer 80 and the surface 56 of the center projection 50 of the diaphragm assembly 34 as previously set forth.

The main blade 101 of the electrical switch unit 33 has an opposed end 117 that is interconnected to an elongated part 118 to which the terminal 111 is welded so as to form part of the subassembly 113. In addition, an L-shaped metallic projection 119 is welded to the end 117 of the main blade 101 and has a leg 120 that is adapted to project through an opening 121 in the housing member 39 as illustrated in FIG. 3.

Thus, it can be seen that the electrical switch unit 33 comprises a self-contained, subassembly 113 that comprises the main blade 101, center blade 84, roll spring 110, terminal 111 and mounting projection means 119 all assembled together so as to be a self-contained unit that can be handled as a one-piece item during the assembly thereof with a housing means of a pressure operated switch construction.

For example, the subassembly 113 can be assembled to the housing member 39 by merely projecting the projection 120 and the terminal 111 respectively through the openings 121' and 112 which positively locate the electrical switch unit 33 in the proper position to the electrical housing member 39 so that once the switch unit 33 is in the proper position, the projection 120 and terminal 111 can be staked to the housing means 39 to fasten the same thereto such as by merely staking downwardly against the projecting portions to form portions of the respective member 120 or 111 which will bear against the external surface 32 of the housing member 39 to fasten the electrical switch unit 33 thereto in the proper assembly position thereof. With the electrical switch unit 33 fastened in the above manner, the spring retainer 80 and diaphragm assembly 34 can then be readily assembled thereto from opposite directions so as to have the cooperating surfaces 85 and 56 sandwich the center blade 84 therebetween in the manner previously set forth.

Figure 7:
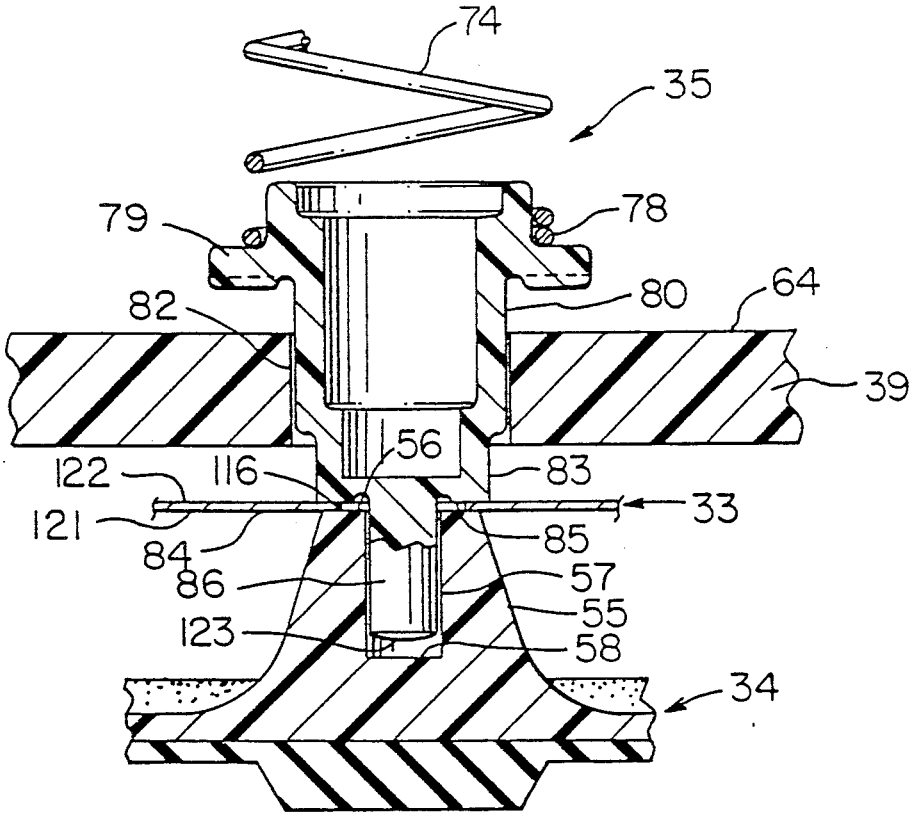
FIG. 7 is an enlarged fragmentary cross-sectional view illustrating the spring actuator of the pressure operated switch construction of FIGS. 1-6 in its operative condition with the switch unit and diaphragm assembly.

In particular, it can readily be seen in FIGS. 3 and 7 that after the electrical switch unit 33 has been mounted to the housing member 39 in the manner previously described, the diaphragm assembly 34 can then be assembled to the housing member 39 by having its outer peripheral portion 44 disposed against the open end 42 of the housing member 39 and the housing member 40 can then be assembled to the housing member 39 by suitably turning over the open end 41 thereof in the manner illustrated in FIG. 3 to not only fasten the diaphragm assembly 34 thereto but also to seal closed the chamber section 47 in a manner well known in the art whereby the interconnected housing members 39 and 40 together with the electrical switch unit 33 and diaphragm assembly 34 therein can then have the compressive spring means 35 assembled thereto or another type of compressive spring means assembled thereto as will be apparent hereinafter.

For example, when it is desired to mount the compressive spring means 35 of this invention to the housing means 31, the retainer 80 can be readily inserted down through the open end of the chamber 63 so as to have the projection 86 thereof pass through the opening means 82 in the wall 64 and project through the opening 116 of the center blade 84 of the electrical switch unit 33 to be received in the opening 57 in the projection 55 of the diaphragm assembly 34 in the manner illustrated in FIG. 7 until the surface 85 of the reduced cylindrical portion 83 of the retainer 80 abuts against the side 122 of the center blade 84 in the manner illustrated in FIG. 7 because an end 123 of the projection 86 of the retainer 80 in the embodiment of the spring means 35 illustrated in FIG. 7 remains spaced from the end 58 of the opening 57 in the projection 55 even when the end surface 56 of the projection 55 is engaging against the side 121 of the center blade 84 at this time as illustrated in FIG. 7. In this manner, the reduced cylindrical part 81 of the retainer 80 is disposed in the opening 82 in the housing member 39 for guiding axial movement of the retainer 80.

Thereafter, the compression spring 74 can be assembled into the chamber 63 with its end 78 being disposed against the disc portion 79 of the retainer 80. Then the spring actuator 77 can be disposed in the chamber 63 so as to have the disc member 76 thereof abut against the end 75 of the spring 74 in the manner illustrated in FIG. 3. Thereafter, to complete the pressure operated switch construction 30, the actuator means 38 can be mounted into the snap-fit means 65 and 37 of the bracket members 59 and 36 so as to be operatively interconnected to the extension 91 of the spring actuator 77 as previously set forth.

In this manner, when the pressure differential acting across the diaphragm assembly 34 is such that in combination with the force of the compression spring 74 tending to move the retainer 80 downwardly, causes the center blade 84 to move downwardly therewith to an over center position thereof, the roll spring 110 snaps the main blade 101 upwardly to place its contact means 102 into contact with the upper fixed contact 103 so as to interconnect the terminal 111 of the electrical switch unit 33 with the terminal 105. Conversely, when the pressure differential acting across the diaphragm assembly 34 in combination with the force of the compression spring 74 is such that the same moves the center blade 84 upwardly to an over center position, the roll spring 110 snaps the main blade 101 downwardly to place its contact 102 into contact with the lower fixed contact 104 so as to interconnect the terminal 11 of the electrical switch unit 33 to the terminal 106 all in a manner and for a purpose that is well known in the art.

However, the compressive spring means 35 of this invention provides such switching action of the main blade 101 with almost no differential action because the center blade 84 is sandwiched between the surfaces 85 of the spring retainer 80 and 56 of the diaphragm assembly 34 in all operating positions of the compressive spring means 35.

However, it is to be understood that the unique features of the compressive spring means of this invention can be utilized to provide other operating actions of the electrical switch unit 33 if desired.

Figure 8:
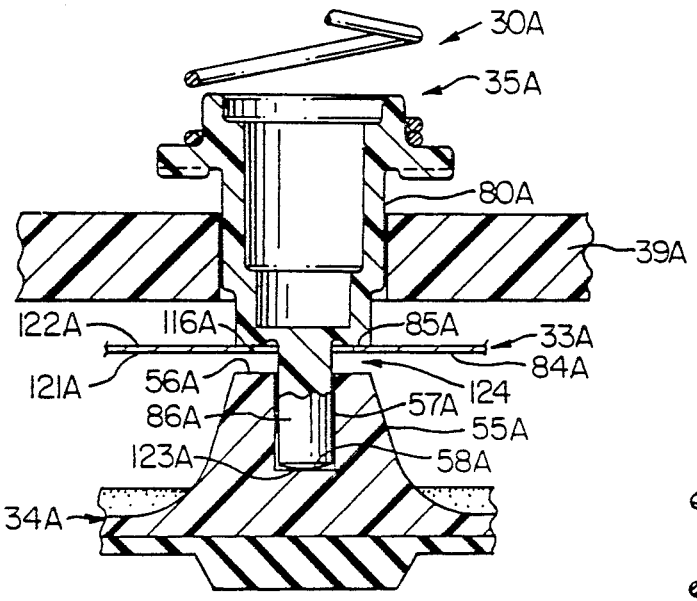
FIG. 8 is a view similar to FIG. 7 and illustrates another embodiment of the retainer of this invention.

For example, another compressive spring means of this invention is generally indicated by the reference numeral 35A in FIG. 8 so as to form another pressure operated switch construction of this invention that is generally indicated by the reference numeral 30A whereby parts of the pressure operated switch construction 30A illustrated in FIG. 8 that are similar to the parts of the pressure operated switch construction 30 previously described are indicated by like reference numerals followed by the reference letter "A".

It can be seen that the compressive spring means 35A of the pressure operated switch construction 30A of FIG. 8 is substantially identical to the compressive spring means 35 previously described except that the projection 86A of the retainer 80A is longer so that the end 123A thereof bottoms out against the end 58A of the opening 57A of the projection 55A of the diaphragm assembly 34A before the surface 56A of the projection 55A can engage against the side 121A of the center blade 84A at the time that the surface 85A of the retainer 80A is engaging against the side 122A of the center blade 84A.

Thus, it can be seen that a space 124 is provided between the surface 56A and the side 121A of the center blade 84A when the compressive spring means 35A is disposed in the condition illustrated in FIG. 8 and this space or gap 124 can be determined by the particular length of the projection 86A of the retainer 80A so that any desired gap or spacing 124 can be provided to provide for a certain differential in the operation of the switch unit 33A for a purpose well known in the art.

Nevertheless, it can be seen that the retainer 80A of the compressive spring means 35A is adapted to be assembled to the housing member 39A after the electrical switch unit 33A and diaphragm assembly 34A have been sealed to the housing means 31A in the manner previously described.

Figure 9:
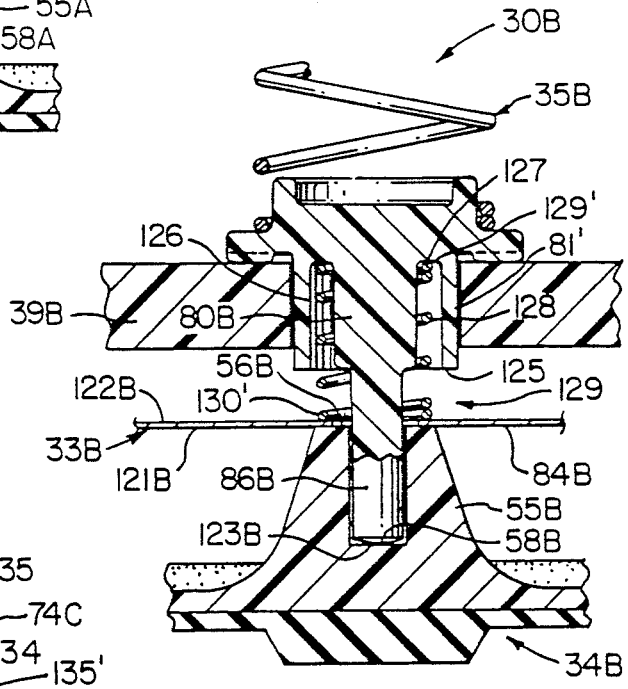
FIG. 9 is a view similar to FIG. 7 and illustrates another embodiment of the retainer of this invention.

In order to provide for a fixed reset type of pressure operated switch construction, another compressive spring means 35B of this invention is provided and is illustrated in FIG. 9 as forming another pressure operated switch construction 30B of this invention wherein the parts thereof that are similar to the pressure operated switch construction 30 previously described are indicated by like reference numerals followed by the reference letter "B".

As illustrated in FIG. 9, the spring retainer 80B has the section 81' thereof provided with an end surface 125 from which the projection 86B extends and does not have the intermediate section 83 previously described for the retainer 80.

However, the end surface 125 of the section 81' of the retainer 80B is interrupted by an annular groove 126 in which an end 127 of a compression spring 128 is disposed and placed against an end surface 129' of the spring retainer 80B. The other end 130' of the spring 128 bears against the side 122B of the center blade 84B as illustrated whereby the surface 125 of the retainer 80B is spaced from the side 122B of the center blade 84B of the electrical switch means 33B by a distance represented by the reference numeral 129 when the surface 56B of the projection 55B of the diaphragm assembly 34B is engaging against the side 121B of the center blade 84B and the end 123B of the projection 86B is engaging against the end surface 58B of the projection 55B as illustrated.

Thus, it can be seen that the retainer 80B of the pressure operated switch construction 30B of FIG. 9 can be dropped in place with the second compressive spring 128 to be assembled with the electrical switch blade unit 33B and diaphragm assembly 34B of the housing means 39B and will provide for a fixed reset type of action for the resulting pressure operated switch construction 30B in a manner well known in the art.

Figure 10:
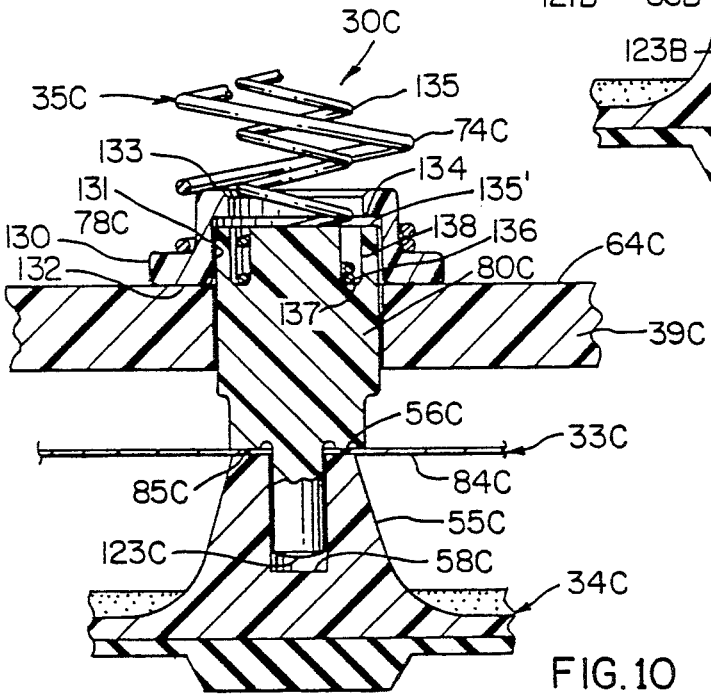
FIG. 10 is a view similar to FIG. 7 and illustrates another embodiment of the retainer of this invention.

In order to provide a varying reset type of pressure operated switch construction, another compressive spring means 35C of this invention is provided and the same is utilized in FIG. 10 to provide a pressure operated switch construction 30C wherein parts thereof similar to the pressure operated switch construction 30 previously set forth are indicated by like reference numerals followed by the reference letter "C".

As illustrated in FIG. 10, the retainer 80C is formed in a manner similar to the retainer 80B except that the same does not have the disc part 79 as a separate disclike member 130 is provided and has a stepped opening 131 passing centrally therethrough and interrupting opposed surfaces 132 and 133 thereof to define an internal annular shoulder 134 which is adapted to be abutted by an end surface 135' of the retainer 80C when the same is moved upwardly from the position illustrated in FIG. 10 in opposition to the force of a second compression spring 135 having one end 136 bearing against an end surface 137 of an annular groove means 138 interrupting the surface 135' as illustrated with the other end (not shown) of the spring 135 bearing against the calibration disc (not shown) of the slide actuator (not shown), such as the disc member 76 of the spring actuator 77 of FIG. 3 in a manner well known in the art along with an adjacent end (not shown) of the compression spring 74C that has its lower end 78C bearing against the disc member 130 to urge the same against the surface 64C of the housing member 39C as illustrated.

Thus, it can be seen that when the compression spring 74C forces the spring retainer 130 against the surface 64C of the housing member 39C, only the force of the compression spring 135 now acts on the retainer 80C to tend to move the same downwardly with the center blade 84C of the electrical switch unit 33C being sandwiched between the cooperating surfaces 85C and 56C of the retainer 80C and the projection 55C of the diaphragm assembly 33C as illustrated as the end 123C of the projection 86C is spaced from the end 58C of the projection 55C under this condition.

Therefore, it can be seen that the retainer 80C can be dropped into place after the switch assembly 33C and diaphragm assembly 34C have been sealed in the housing means 31C with the spring retainer 130C and springs 135 and 74C being thereafter assembled thereon in the manner previously set forth to complete the assembly along with a suitable actuator, such as the spring actuator 77 previously set forth.

Accordingly, it can be seen that in each of the pressure operated switch constructions 30, 30A, 30B and 30C previously set forth, the retainer 80, 80A, 80B and 80C thereof is adapted to be readily removed from the particular switchblade unit 33, 33A, 33B or 33C by merely pulling outwardly on the retainer 80, 80A, 80B or 80C in a direction opposite to the assembling direction thereof as previously set forth so that the particular pressure operated switch construction can have another compressive spring means assembled thereto if desired.

Conversely, when forming any desired pressure operated switch construction 30, 30A, 30B or 30C of this invention, it can be seen that the same preassembled housing means 31 can be used and the desired retainer 80, 80A, 80B or 80C can be assembled thereto by merely dropping the same from the outside of the housing means 31 into its assembled relation with the switch unit and diaphragm assembly thereof.

While the pressure operated switch constructions 30, 30A, 30B and 30C have each been described as having a movable actuator for setting the compressive force of the main compressive spring 74, 74A, 74B and 74C thereof, such as the spring actuator 77, it is to be understood that a fixed setting actuator could be provided therefor.

Figure 11:
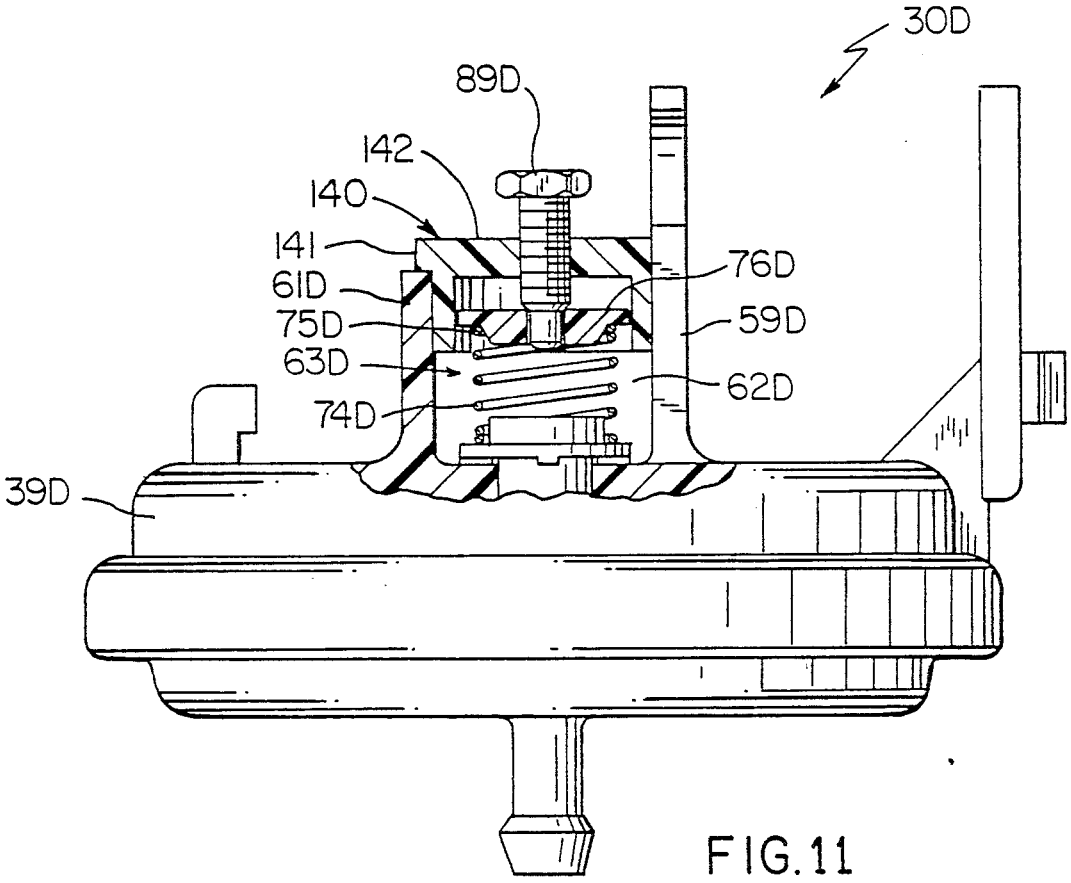
FIG. 11 is a view similar to FIG. 2 and illustrates another pressure operated switch construction of this invention.

For example, another pressure operated switch construction of this invention is generally indicated by the reference numeral 30D in FIG. 11 and parts thereof similar to the pressure operated switch construction 30 are indicated by like reference numerals followed by the reference letter "D".

As illustrated in FIG. 11, the pressure operated switch construction 30D does not have the rotary actuator means 38 and in place of the sliding spring actuator 77, a fixed actuator 140 is snap-fit into the chamber 63D defined by the walls 59D, 60D, 61D and 62D of the housing body member 39D with the actuator 140 having a part 141 engaging against the top of the walls as illustrated in FIG. 11 and having its closed end 142 carrying the threaded adjusting member 89D for calibrating the disc member 76D that acts on the end 75D of the compression spring 74D as previously set forth.

Figure 12:
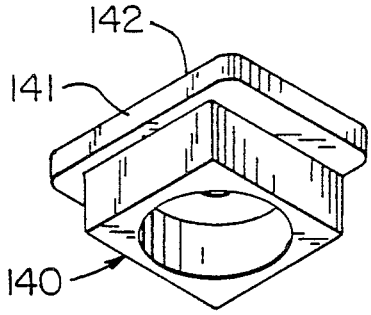
FIG. 12 is a perspective view of the actuator of the pressure operated switch construction of FIG. 11.

The fixed actuator 140 is substantially rectangularly shaped as illustrated in FIG. 12 to cooperate with the rectangularly shaped chamber 63 to provide a fixed setting of the compression spring 74D for a purpose well known in the art, the fixed actuator 140 being formed of any suitable material, such as plastic material as illustrated.

Therefore, it can be seen that the compressive spring means of this invention minimize the part variations that are due to customers' requirements because all of the variable parts related to the differential action of the pressure operated switch construction of a pressure operated switch construction have been moved to the outside of the sealed switch construction which permits a retainer to be dropped in from the outside of the sealed body and be effectively assembled to the operating parts in the sealed body. Thus, the parts contained in the sealed portion of the switch body are common to any pressure switch design and this allows the stocking of switch subs of the housing body so that when an order is received, such sub can be utilized with outside components to complete that order.

Therefore, it can be seen that this invention not only provides a new switch construction but also this invention provides a new method of making such a pressure operated switch construction.

While the forms and methods of this invention now preferred have been illustrated and described as required by the Patent Statute, it is to be understood that other forms and method steps can be utilized and still fall within the scope of the appended claims wherein each claim sets forth what is believed to be known in each claim prior to this invention in the portion of each claim that is disposed before the terms "the improvement" and sets forth what is believed to be new in each claim according to this invention in the portion of each claim that is disposed after the terms "the improvement" whereby it is believed that each claim sets forth a novel, useful and unobvious invention within the purview of the Patent Statute.

What is claimed is:

1. In a pressure operated switch construction comprising a housing means having an external surface means and carrying an electrical switch unit and a diaphragm assembly therein, said housing means having an opening means passing through said external surface means thereof, said electrical switch unit having a center blade means provided with opposed sides and an opening passing therethrough in alignment with said opening means, and a compression spring means carried by said housing means and being operatively associated with said electrical switch unit and said diaphragm assembly to control the operation thereof in relation to the compression setting of said compression spring means, said compression spring means comprising a retainer operatively interconnected to said electrical switch unit, an actuator carried by said housing means, and a first compression spring having opposed end means respectively bearing against said actuator and said retainer, said retainer having an intermediate part thereof disposed in said opening means of said housing means and having a surface means and a projection means extending from said surface means and passing through said opening of said electrical switch unit in one direction so that said surface means faces one of said sides of said center blade means whereby said retainer is removable from said electrical switch unit by merely moving said retainer in the direction opposite to said one direction, said diaphragm assembly being disposed adjacent the other of said sides of said center blade means of said electrical switch unit and having a projection means extending outwardly therefrom, said projection means of said diaphragm assembly having a surface means facing said other side of said center blade means of said electrical switch unit and being interrupted by an opening means that receives said projection means of said retainer therein whereby said projection means of said retainer aligns said first compression spring with said projection means of said diaphragm assembly, the improvement wherein said compression spring means comprises a second compression spring having one end thereof bearing against said surface means of said retainer and having another end thereof bearing against said one of said sides of said center blade means to tend to hold said other of said sides of said center blade means against said surface means of said projection means of said diaphragm assembly whereby movement of said projection means of said diaphragm assembly relative to said housing means controls the position of said center blade means.

2. A pressure operated switch construction as set forth in claim 1 wherein said surface means of said retainer is interrupted by an annular groove means which receives therein said one end of said second compression spring.

3. A pressure operated switch construction as set forth in claim 1 wherein said diaphragm assembly comprises a flexible diaphragm and a diaphragm backup plate means carried thereby, said projection means of said diaphragm assembly comprising a part of said diaphragm backup plate means.

* * * * *